United States Patent [19]

Brouillette et al.

[11] 3,974,323

[45] Aug. 10, 1976

[54] METAL ARTICLE HAVING PROTECTIVE THIN FILM COATING AND METHOD OF APPLYING

[75] Inventors: Carl V. Brouillette, Liberty, Mo.; Harry Hochman, Oxnard, Calif.

[73] Assignee: The United States of America as represented by the Secretary of the Navy, Washington, D.C.

[22] Filed: Nov. 19, 1973

[21] Appl. No.: 417,339

[52] U.S. Cl. ..... 428/457; 21/2.5 R; 21/DIG. 2; 252/390; 427/54; 428/539

[51] Int. Cl.[2] ..... B05D 3/06

[58] Field of Search ..... 21/2.5 R, DIG. 2; 117/93.31, 127, 132 R; 252/390; 427/54; 428/457, 538, 539

[56] References Cited

UNITED STATES PATENTS

| | | | |
|---|---|---|---|
| 2,476,554 | 7/1949 | Lincoln et al. | 252/390 |
| 2,485,309 | 10/1949 | Nunn | 117/127 |
| 2,591,583 | 4/1952 | Moody | 252/390 |
| 2,629,693 | 2/1953 | Barton et al. | 252/390 |

OTHER PUBLICATIONS

Mann et al. "Industrial & Eng. Chem." vol. 28, No. 2 pp. 159–163.

*Primary Examiner*—John H. Newsome
*Attorney, Agent, or Firm*—Richard S. Sciascia; Joseph M. St. Amand

[57] ABSTRACT

Amino compounds are applied to steel and aluminum by direct application and also from solution, and then subjected to ultraviolet radiation to produce photooxidative polymerization of the coating on the surface of the metal. Adherent thin film polymers are thus produced on the metal which resist wetting and are corrosion resistant to prevent rust or oxidation of the metal.

23 Claims, No Drawings

METAL ARTICLE HAVING PROTECTIVE THIN FILM COATING AND METHOD OF APPLYING

BACKGROUND OF THE INVENTION

Field of the Invention

This invention relates to protective coatings and more particularly to corrosion resistant coatings for metals to protect tools, equipment, and the like which are exposed to moisture in the atmosphere.

SUMMARY OF THE INVENTION

Steel and aluminum metals, for example, are coated with a thin film of o-phenylene diamine and then exposed to ultraviolet light or sunlight. The amine compound, after being exposed to ultraviolet light for a short period of time, decomposes and forms a corrosion resistant film on the metal. The film is very adherent and is easily produced by washing the metal surface with a solution of o-phenylene diamine and alcohol or other suitable solvent, followed by exposure to ultraviolet light for a short period of time. Heat may be used, if desired, to speed the drying time of the solution, but is not required. On steel, the surface darkens to a blue-black coloration as the amine decomposes and the polymer is formed on the metal surface. The film forms a corrosion resistant surface on both polished metal as well as on metal covered with a thin rust or oxide coating. Washing a bare metal surface at outdoor sites with the amine solution will stop corrosion, thus permitting more flexible construction schedules for erection of a metal structure when a protective coating has been applied to the metal. The amine can be applied to metal in storage or as added to a structure to provide a thin film protective coating.

It is an object of the invention, therefore, to provide a corrosion resistant thin film for use on bare metal.

It is another object of the invention to provide a corrosion resistant thin film over polished metal or metal having a thin oxide or rust coating.

Another object of the invention is to provide a thin film polymer protective coating for metal.

A further object of the invention is to provide a thin film polymer or metal complex coating on a metal surface by photo-oxidation and subsequent decomposition of phenylenediamine.

Other objects, advantages and novel features of the present invention will become apparent from the following detailed description of the invention.

DETAILED DESCRIPTION OF THE PREFERRED EMBODIMENT

A blue-black coloration was produced on a steel surface that was in contact with phenylenediamine dust and then exposed to sunlight. This film was very difficult to remove from the steel and had corrosion inhibiting properties. This tightly adhering coloration was a thin film polymer produced by photo-oxidation and subsequent decomposition of the phenylenediamine. The resulting black product, as a thin film polymer or complex with iron, gave the blue protective film. The film, being generically of amine origin, enhances the bonding of an amine or amide-cured protective coating.

The photo-oxidation of aniline produces the familiar degradation product known as aniline black. The formation of this blue-black film on the surface of steel was initiated using aniline. Research was conducted by passing aniline vapor past a steel surface in the presence of ultraviolet radiation produced by a xenon-arc or a mercury lamp. Natural daylight and an infrared heat lamp were used also. It was found that condensation of aniline on the steel surface was required to produce appreciable darkening on the steel. The mercury lamp irradiation produced this darkening much faster than the xenon arc or other photo-energy sources. Corrosion experiments in a salt-spray cabinet showed the thin film polymer to have a mitigating effect on the amount of corrosion developed. Subsequent work was done using different amino compounds placed into direct contact with steel. Photo-oxidation was attempted using a George W. Gates & Company mercury vapor lamp, Model 420-U1, 360 watts.

The reaction of the phenylenediamines, as well as other amines more susceptible to ultraviolet photo-oxidation than aniline, were investigated.

PROCEDURE:

The following amine compounds were used to investigate thin film polymer formation or a protective iron complex on the surface of steel:

propylenediamine
hydroxyethyl-ethylenediamine
auramine
p-p′ methylenedianiline
diphenylamine
melamine
hexamethylenetetramine
N-N diethyl-p-phenylenediamine
o-phenylenediamine
m-phenylenediamine
p-phenylenediamine Certain compounds act as sensitizers in a photo-oxidative process and others contribute as quenchers. Benzene and aniline appear to contribute as sensitizers and benzil as a quenching agent. Each of the above 12 amines were applied to the surface of steel test specimens in their natural state and from solution in both aniline and benzene. Separate tests were made using each amine in aniline and benzene as solvents, each containing the quenching agent benzil in the solution.

Application of crystalline amines was by rubbing onto the surface of the steel. Liquid amines and solutions were applied by wiping onto the steel. After application, the treated steel test specimens were subjected to 16 hours of radiation from the mercury vapor u.v. lamp. The test specimens were placed 15 inches from the u.v. light source.

Alcoholic or other suitable solvents can also be used for making solutions having amines dissolved therein.

The following tests were conducted:

Test 1

The amine was rubbed or wiped onto the steel test specimen and exposed to the u.v. radiation.

Test 2

The amine was dissolved in benzene (0.1g amine in 10.0 ml benzene), applied to steel and exposed to the u.v. radiation.

Test 3

The amine was dissolved in aniline (0.1 g. amine in 10 ml aniline), applied to the steel and exposed to the u.v. radiation.

Test 4

The amine was dissolved in Solution 1 (0.1g amine in 10.0 ml Solution 1), applied to the steel and exposed to u.v. radiation. (Solution 1 was prepared by dissolving 3g of benzil in 300 ml of benzene.)

Test 5

The amine was dissolved in Solution 2 (0.1g amine in 10.0 ml Solution 2), applied to the steel and exposed to the u.v. radiation. (Solution 2 was prepared by dissolving 3g of benzil in 300 ml of aniline.)

Test 6

The amine was dissolved in a 50/50 mixture of Solutions 1 and 2 (0.1 g of amine in 10.0 ml of the mixed solutions), applied to the steel, and exposed to the u.v. radiation.

After the amine coated steel panels were exposed to the u.v. radiation for 16 hours, three tests were made to qualitatively determine if a thin film polymer had formed on the steel surface. The change in color of the steel surface was indicative of thin film polymer formation. If rubbing or washing did not remove the coloration, a few test drops of 1N hydrochloric acid were applied. It was decided on the basis of comparative tests that 0.1N acid would better identify superior films. If the film was not removed or was attacked very slowly, a protective film had formed.

RESULTS:

Thin film polymers or iron complexes on steel were produced by several of the amines tested. The results are shown in Table 1 below:

TABLE 1

THIN FILM FORMATION

| Amine | Tests 1 | 2 | 3 | 4 | 5 | 6 |
|---|---|---|---|---|---|---|
| propylenediamine | – | – | – | – | + | 0 |
| hydroxyethyl-ethylenediamine | – | – | – | – | – | 0 |
| ethylenediamine | – | – | – | – | – | 0 |
| auramine | – | – | – | – | – | 0 |
| p-p′ methylenedianiline | + | + | – | ++ | – | ++ |
| diphenylamine | + | – | – | ++ | – | ++ |
| melamine | + | – | – | – | ++ | ++ |
| hexamethylenetetramine | – | – | + | + | – | 0 |
| N-N diethyl p-phenylenediamine | – | – | + | – | – | 0 |
| o-phenylenediamine | + | – | + | + | + | ++ |
| m-phenylenediamine | + | – | + | ++ | + | ++ |
| p-phenylenediamine | + | – | + | + | + | ++ |

+ indicates film formation
– indicates film, if any, washed off easily with water
++ film most resistant to washing and acid
0 no test run The phenylenediamines appeared to most easily produce a thin film on the steel surface. The films were more pronounced when prepared by Tests 4 and 6, and to some extent Test 5. The films produced during these tests, which did not wash off, were hydrophobic; water did not wet the film during washing. In addition to the phenylenediamines, the following amines produced promising films on steel; p-p′ methylenedianiline, diphenylamine, and melamine. Thin film polymers were produced which resisted wash off by water, and rust did not form through the polymer when water dried on the film. The thin film polymers produced by p-p′ methylenedianiline, diphenylamine and m-phenylenediamine, each applied as in Test 4 (dissolved in Solution 1), melamine, applied as in Test 5 (dissolved in Solution 2), and p-p′ methylenedianiline, diphenylamine, melamine, o-, m-, and p-phenylenediamine applied as in Test 6 (Solutions 1 and 2 mixed) produced thin polymer films which had the greatest resistance to attack by 1N hydrochloric acid. The melamine applied as in Test 5 (dissolved in Solution 2) produced a thin film polymer most resistant to the acid attack.

It was also observed that the same or similar type coating was formed on aluminum coated with o-phenylenediamine and exposed to ultraviolet light. The compound decomposed to form a corrosion resistant polymer or aluminum complex on the aluminum surface, which in turn protected the aluminum from oxidation. Other metals than steel and aluminum can also be protected by such thin film polymers or metal complexes produced thereon.

These thin film type polymers or metal complexes produced by photo-oxidation on the surface of steel and aluminum are water resistant and have a tendency for protecting steel from rusting and aluminum from oxidizing. The ability to produce photo-degradation products on steel and aluminum to provide coatings thereon, resistant to corrosion in a marine atmospheric environment, was established by the foregoing experiments. It was also shown that the various techniques of application, as discussed, influence the properties of these films.

Obviously many modifications and variations of the present invention are possible in light of the above teachings. It is therefore to be understood that within the scope of the appended claims the invention may be practiced otherwise than as specifically described.

We claim:

1. A coated metal article comprising a metal substrate with a protective thin film coating thereon for inhibiting corrosion and oxidation of the metal surface due to elements in the atmosphere and in a marine atmospheric environment, comprising:

a. a coating of an amine compound adhered onto the surface of the metal substrate;

b. said amine compound coating being in the form of a photo-oxidative polymerized thin film cured on and bonded to the metal surface;

c. said cured coating being a thin film polymer/metal complex which is hydrophobic, and corrosion and oxidation inhibiting.

2. A coated article as in claim 1 wherein said amine compound is selected from: propylenediamine, p-p′ methylenedianiline, diphenylamine, melamine, hexamethylenetetramine, N-N diethyl-p-phenylenediamine, o-phenylene-diamine, m-phenylenediamine, and p-phenylenediamine.

3. A coated metal article as in claim 1 wherein said metal surface is steel.

4. A coated metal article as in claim 1 wherein said metal surface is aluminum.

5. A coated article as in claim 1 wherein said amine compound is a phenylenediamine.

6. A coated article as in claim 5 wherein said phenylenediamine is any of o-phenylenediamine, m-phenylenediamine and p-phenylenediamine.

7. A coated article as in claim 1 wherein said amine compound is any of phenylenediamine, melamine, diphenylamine and p-p′ methylenedianiline.

8. A method for treating metal and metal having an oxide coating for producing a protective surface thereon resistant to corrosion in a marine atmospheric environment, comprising:

a. applying to the metal surface an amine compound thin film coating selected from the group consisting of:
propylenediamine
p-p′ methylenedianiline
diphenylamine
melamine
hexamethylenetetramine
N-N diethyl-p-phenylenediamine
o-phenylenediamine
m-phenylenediamine
p-phenylenediamine;

b. curing the coating by producing photo-oxidative polymerization thereof through the means of irradiating the thin film coating with ultraviolet energy, thus forming a tightly adherent thin film polymer/-metal complex on the surface of the metal which is hydrophobic, and resists corrosion due to moisture, oxidation, and acid attack.

9. A method as in claim 8 wherein said amine compound coating is applied to the metal surface in solution form with 0.1 grams of amine per 10.0 ml solution.

10. A method as in claim 9 wherein said solution in which the amine compound is dissolved consists of 3 grams of benzil per 300 ml of benzene.

11. A method as in claim 9 wherein said solution, in which said amine compound is dissolved, consists of 3 grams of benzil per 300 ml of aniline.

12. A method as in claim 9 wherein said solution, in which said amine compound is dissolved, consists of 3 grams of benzil per mixture of 150 ml of benzene and 150 ml of aniline.

13. A method as in claim 8 wherein said amine compound is in powdered crystalline form which is rubbed onto the surface of the metal.

14. A method as in claim 8 wherein said amine compound coating is applied to the metal surface in a solution of p-p′ methylenedianiline dissolved in benzene, 0.1 gram amine per 10.0 ml benzene.

15. A method as in claim 8 wherein said amine compound coating is applied to the metal surface in a solution of amine dissolved in aniline, 0.1 gram amine per 10 ml aniline.

16. A method as in claim 9 wherein said solution in which the amine compound is dissolved consists of 3 grams of benzil per 300 ml of the mixture consisting of from 0 to 300 ml of benzene and from 0 to 300 ml of aniline.

17. A method as in claim 9 wherein said solution in which the amine compound is dissolved consists of from 0 to 10 ml of benzene per 0 to 10 ml of aniline.

18. The method as in claim 8 wherein said amine compound is applied to the metal surface by washing the metal surface with a solution of amine compound in a suitable solvent and applying sufficient heat to speed the drying time of the coating.

19. The method as in claim 8 wherein said amine compound is in solution with a suitable solvent, applied to the metal surface as a vapor and condensed thereon.

20. The method as in claim 8 wherein said thin film amine compound coating initially applied is used to enhance the bonding of another amine protective coating thereto.

21. The method as in claim 8 wherein said thin film amine compound coating initially applied is used to enhance the bonding of an amide-cured protective coating thereto.

22. The method as in claim 8 wherein said amine compound is applied to the metal surface in a suitable solution of solvent which contributes as a sensitizer to the photo-oxidative process, said solution also containing a quenching agent.

23. The method as in claim 22 wherein said solvent which contributes to the photo-oxidative process is selected from at least one of aniline and benzene, and said quenching agent is benzil.

* * * * *